United States Patent [19]

Grebner et al.

[11] 4,154,997

[45] May 15, 1979

[54] MINIATURE MULTI-CONTACT PUSHBUTTON SWITCH

[75] Inventors: Stuart W. Grebner, Cleveland, Ohio; Tony O. Woodard, Pine Level, N.C.

[73] Assignee: Cutler-Hammer, Inc., Milwaukee, Wis.

[21] Appl. No.: 699,875

[22] Filed: Jun. 25, 1976

[51] Int. Cl.[2] ..... H01H 3/12

[52] U.S. Cl. ..... 200/159 R; 200/61.78; 200/277

[58] Field of Search ..... 200/159, 159 A, 159 B, 200/276, 277, 295, 303, 61.76, 61.78

[56] References Cited

U.S. PATENT DOCUMENTS

| | | | |
|---|---|---|---|
| 2,606,980 | 8/1952 | Woofter | 200/61.76 |
| 3,098,141 | 7/1963 | Wintriss | 200/159 B |
| 3,145,270 | 8/1964 | Brown | 200/159 R X |
| 3,597,564 | 8/1971 | Lewis | 200/303 X |
| 3,736,397 | 5/1973 | Pedersen | 200/340 |
| 3,773,997 | 11/1973 | Evans | 200/159 B |
| 3,883,705 | 5/1975 | Sebastian | 200/303 |
| 3,895,198 | 7/1975 | Piber | 200/159 R |
| 3,934,104 | 1/1976 | Stout | 200/159 R |

*Primary Examiner*—Harold J. Tudor

[57] ABSTRACT

A pushbutton switch having an extremely small size for its number of contacts and capability. The switch has a tubular insulating housing with the snap-in pushbutton non-rotatably keyed in and extending through the upper reduced bushing end thereof for longitudinal reciprocal movement. Bifurcated spring contacts are molded into a snap-in base and extend upwardly therefrom into the housing. A ring-shaped common terminal is snap-in attached to the base before snap-in assembly thereof in the housing. A cylindrical bar movable contact guided in grooves in the housing is snap-in assembled between tabs in the bifurcated inner end of the snap-in pushbutton and keeps the snap-in tabs spread apart to prevent removal of the pushbutton from the housing. A helical return spring lines the walls of the housing and is compressed between the common terminal and the ends of the movable contact bar to act as both a return spring and as a connector. A tactile tongue integral with the pushbutton acts on the housing to provide operating position "feel" to enable the user to sense when the contacts close.

15 Claims, 7 Drawing Figures

MINIATURE MULTI-CONTACT PUSHBUTTON SWITCH

BACKGROUND OF THE INVENTION

Multi-contact pushbutton switches have been known heretofore. However, such switches have had a rather large size with respect to the number of contacts and capability. Moreover, such prior switches have had the disadvantages of being rather complex in both structure and method of assembly and thus costly to manufacture. While these prior switches have been useful for their intended purposes, this invention relates to improvements thereover.

SUMMARY OF THE INVENTION

An object of the invention is to provide an improved miniature pushbutton switch.

A more specific object of the invention is to provide a multi-contact pushbutton switch having an extremely small size for its number of contacts and capability.

Another specific object of the invention is to provide a very small multiple-contact pushbutton switch that is simple in construction and easy to assemble.

Another specific object of the invention is to provide a pushbutton switch with improved snap-in parts making it easy and economical to assemble.

Another specific object of the invention is to provide a multi-contact switch with an improved pushbutton incorporating snap-in assembly into the switch housing, keyed non-rotatability in the housing, snap-in retention of the movable contact combined with trapping the pushbutton to prevent removal from the housing, and tactile operating action.

Another specific object of the invention is to provide a miniature pushbutton switch with an improved switch base incorporating snap-on retention of a common terminal, snap-in assembly of the base into the switch housing and a coil spring serving as both a return spring for the pushbutton and as a common connector between the movable contact and the common terminal.

Other objects and advantages of the invention will hereinafter appear.

DESCRIPTION OF THE PREFERRED EMBODIMENT

Figure 1:
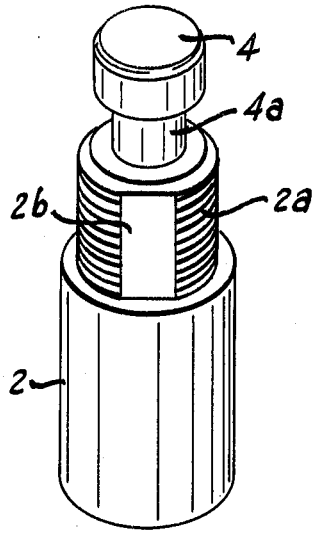
FIG. 1 is an enlarged view of a miniature multi-contact pushbutton switch according to the invention showing its exterior characteristics.

Referring to FIG. 1, there is shown a miniature multi-contact pushbutton switch according to the invention except that this switch is actually much smaller, it being illustrated enlarged three times in FIG. 1. Actually this switch is extremely small, only about one inch high from the top of the pushbutton to the lower tips of the terminals and less than one-third inch at its largest diameter. As shown therein, this switch is provided with a generally cylindrical, insulating housing 2 having a reduced-diameter, threaded bushing portion 2*a* at its upper end. This upper end bushing is adapted to be inserted through a hole in a mounting panel and a nut turned thereon to mount the switch to the panel. This threaded section 2*a* is provided with a flat portion 2*b* on both sides whereby it is keyed non-rotatably in a complementary-shaped hole in the panel. An enlarged-head pushbutton 4 extends out from the round bore of this threaded bushing and is adapted to be depressed to operate the switch as hereinafter more fully described.

Figure 2:
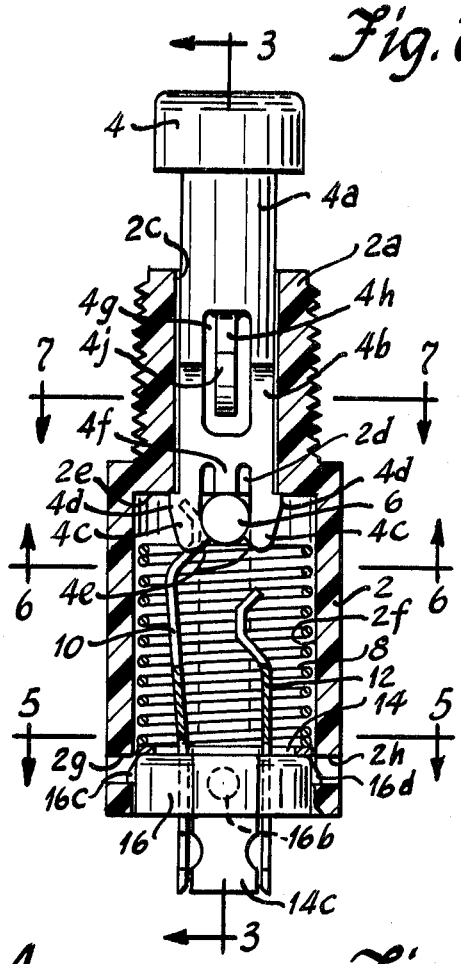
FIG. 2 is a still further enlarged vertical cross-sectional view of the switch taken along line 2—2 of FIG. 3 showing the internal parts thereof.
Figure 3:
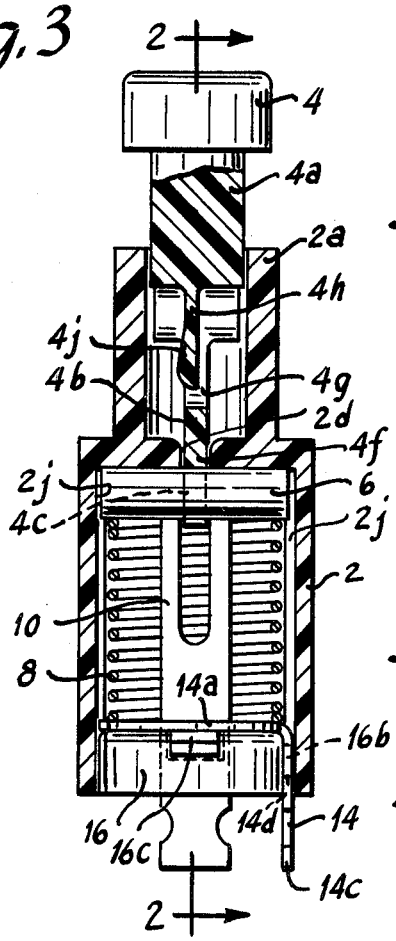
FIG. 3 is a transverse vertical cross-sectional view of the switch taken along line 3—3 of FIG. 2 showing the internal parts from a different direction.
Figure 4:
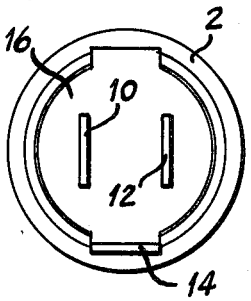
FIG. 4 is a bottom view of the switch of FIG. 2 showing the arrangement of the three terminals.
Figure 7:
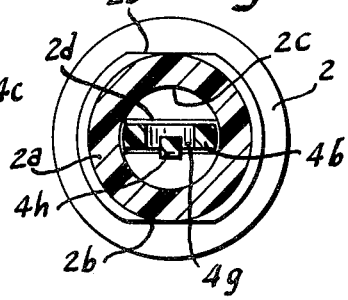
FIG. 7 is a downward, horizontal cross-sectional view taken through the bushing along line 7—7 of FIG. 2 showing the keyed portion of the pushbutton and the tactile finger.

Pushbutton 4 is non-rotatably keyed in housing 2 while being mounted for reciprocal longitudinal movement therein as shown in FIGS. 2, 3 and 7. For this purpose, cylindrical shank 4*a* of the pushbutton is reduced at its lower end to a symmetrical flat section 4*b* as shown in FIG. 3 and round hole 2*c* in the upper, threaded bushing portion of the housing is reduced at its lower end to a constricted, flat hole 2*d* complementary to and closely hugging and non-rotatably guiding flat section 4*b* of the pushbutton as shown in FIGS. 3 and 7.

This pushbutton is provided with snap-in mounting means for assembling it in the housing and retaining it therein. This means comprises bifurcated lower end portions 4*c* having respective lateral hooks 4*d* with their outer edges tapered inwardly and downwardly to facilitate insertion thereof into the hole in the bushing. Thus, when the pushbutton is inserted in the hole in the bushing, these resilient bifurcated end portions or fingers flex inwardly allowing hooks 4*d* to be squeezed into the hole in the bushing. These hooks then slide down along the opposite walls of hole 2*c*–2*d* and snap-out below shoulder 2*e* at the lower end of this hole where entry is made into the larger diameter contact compartment 2*f* as shown in FIG. 2.

This pushbutton is also provided with movable contact retaining or carrying means and self-locking means that prevents removal of the pushbutton from the housing. This means comprises a pair of inwardly-directed and opposed lugs 4*e* and a central abutment lug 4*f* on and between the bifurcated portions 4*c* at the lower end of the pushbutton. After the pushbutton has been snapped into the housing as hereinbefore described and fully depressed, movable contact 6, which is a cylindrical conductive metal bar or rod, is inserted from the bottom of the housing with the ends of the movable contact sliding along opposed sidewall grooves 2*j*, more clearly shown in FIG. 6. Movable contact 6 is then forced between the bifurcated portions 4*c*, causing lugs 4*e* to spread apart as these bifurcated fingers 4*c* flex apart to allow the movable contact to be snap-in assembled up against abutment lug 4*f*. This movable contact is retained by lugs 4*e* so as to be carried by and movable down and up by the pushbutton plunger. This movable contact retains these fingers 4*c* from flexing inwardly and thus keeps them spread apart so that hooks 4*d* keep the pushbutton locked in the housing while allowing it to be pressed down against the force of return spring 8.

This pushbutton is further provided with tactile means affording the user a "feel" of the switch actuation and thus to inform the operator of the moment of contact closure or opening. This means comprises an opening 4g in the pushbutton extending across the junction between cylindrical shank 4a and flat section 4b as shown in FIGS. 2 and 7 and an integrally molded tactile finger 4h extending down into this opening from its upper edge. As shown in FIG. 3, this tactile finger has a cam surface 4j that engages the edge of flat hole 2d in the housing. The lower end portion of this tactile finger cam surface has a short radius curvature that continues upwardly in a gradual slope. As a result, when the pushbutton is depressed, the short radius curvature will provide an abrupt hesitation feel and then the tactile finger will flex suddenly toward the center and pass through hole 2d. On return movement of the pushbutton, the gradual slope will reduce drag and will help the return spring return the pushbutton with a minimum of force.

This switch is provided with combined return spring and common connector means. This means comprises a helical compression spring 8 large enough in diameter to hug the walls of the cylindrical switch compartment 2f of the housing and to freely surround stationary contacts 10 and 12 therein. This compression spring 8 rests on ring-shaped common terminal 14 and applies an upward bias on movable contact 6 normally to maintain pushbutton 4 in its upwardly extended position as shown in FIG. 2. Each time the pushbutton is released following depression thereof, this spring restores the pushbutton to its normal position shown in FIG. 2. This spring also serves as an electrical connector between movable contact 6 and common terminal 14.

Figure 5:
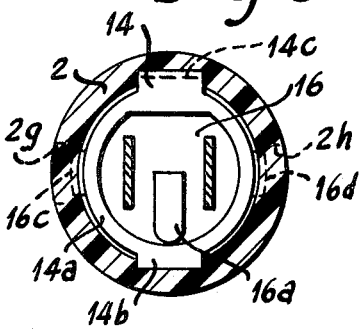
FIG. 5 is a downward, horizontal cross-sectional view taken just above the base along line 5—5 of FIG. 2 showing the common terminal and the base.

This common terminal 14 is more clearly shown in FIG. 5. This terminal has a generally flat ring-shaped portion 14a overlying disk-shaped snap-in base 16 and including lugs 14b on opposite edges of this ring fitting into grooves 2f in the interior walls of the housing as shown in FIG. 5. To assemble this common terminal onto base 16, one side of ring 14a thereof is hooked behind lug 16a on the upper surface of the base and then the downwardly bent terminal portion 14c thereof, which is a continuation of the corresponding lug 14b, is pulled down until round hole 14d therein snaps over round, side lug 16b of the base as shown in FIG. 3. This locks the common terminal to the base whereafter the base is snap-in assembled on the housing.

Stationary, spring contacts 10 and 12 are molded into base 16 so that their contact portions extend upwardly into the switch compartment and their terminal portions extend downwardly to the exterior for connection to an external circuit. As shown in FIG. 2, stationary contacts 10 and 12 have different lengths, stationary contact 10 being longer so that it is normally closed with respect to movable contact 6 whereas stationary contact 12 is shorter and thus normally open with respect thereto. Therefore, the embodiment illustrated is a single-pole double-throw switch. Normally, a closed circuit is established between common terminal 14 and stationary contact 10 through spring 8 and movable contact 6. When the pushbutton is depressed, this circuit is opened and a circuit is closed from the common terminal to stationary contact 12 through spring 8 and movable contact 6.

The switch is provided with snap-in means for assembling the base on the housing. This means comprises a pair of tapered lugs 16c and 16d, one on each side of the base, preferably spaced 90 degrees in different directions from side lug 16b, and a pair of slots 2g and 2h, one on each side of the housing, for receiving the respective tapered lugs 16c and 16d when the base is pressed into the bottom opening of the housing. These lugs 16c and 16d have their upper surfaces tapered or beveled so that they can be cammed into the bottom hole of the housing, the sides of which hole are also beveled, causing the resilient, molded plastic housing to flex enough to receive them whereafter these lugs will snap-in at holes or slots 2g and 2h to lock the base to the housing and retain it therein.

Figure 6:
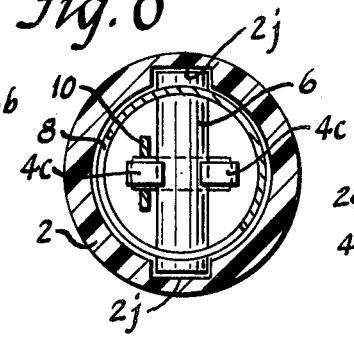
FIG. 6 is an upward, horizontal cross-sectional view taken through the switch compartment along line 6—6 of FIG. 2 showing the movable contact and lower end of the pushbutton.

To assure good electrical contact between the movable and stationary contacts, the latter are bifurcated as shown in FIGS. 2, 3 and 6 so as to provide two contact tips on each stationary contact for independent resiliency and engagement with movable contact. While the stationary contacts have been illustrated and described as having particular lengths and shapes to provide a double-throw switch, it will be apparent that other forms of stationary contacts and numbers thereof are possible. The terminals are provided with suitable side notches as shown in FIGS. 2 and 3 to facilitate attachment of slip-on wire connectors thereon.

While the apparatus hereinbefore described is effectively adapted to fulfill the objects stated, it is to be understood that the invention is not intended to be confined to the particular preferred embodiment of miniature multi-contact push-button switch disclosed, inasmuch as it is susceptible of various modifications without departing from the scope of the appended claims.

We claim:

1. A miniature pushbutton switch comprising:

an insulating housing having first and second openings and a switch compartment;

a pushbutton extending through said first opening;

first snap-in means mounting said pushbutton for limited reciprocal longitudinal movement in said housing and non-rotatably keying said pushbutton in said housing;

a movable contact in said switch compartment;

second snap-in means mounting said movable contact on said pushbutton so that it provides an abutment for said first snap-in means to prevent removal of said pushbutton from said housing;

an insulating base carrying stationary contact means and a common terminal;

third snap-in means mounting said base in said second opening of said housing to position said stationary contact means for engagement by said movable contact within said switch compartment;

and resilient means between said common terminal and said movable contact serving both as an electrical connector and as a pushbutton return spring.

2. The miniature pushbutton switch defined in claim 1, wherein:

said first snap-in means comprises a section at the internal end of said pushbutton divided into a pair of spaced parallel resilient fingers having snap-in hooks at their opposite sides providing interference with the opposite sides of said first opening thereby requiring said fingers to flex toward one another when said pushbutton is snap-in mounted in said housing.

3. The miniature pushbutton switch defined in claim 1, wherein:

said first snap-in means comprises complementary flat portions on said pushbutton and the wall of said first opening mounting said pushbutton non-rotatably in said housing and abutments allowing limited longitudinal movement of said pushbutton in said first opening.

4. The miniature pushbutton switch defined in claim 1, wherein:

said second snap-in means comprises a section at the internal end of said pushbutton divided into a pair of spaced parallel resilient fingers having snap-in lugs on their adjacent sides providing interference with said movable contact thereby requiring said fingers to flex apart when said movable contact is snap-in mounted therebetween.

5. The miniature pushbutton switch defined in claim 1, wherein:

said insulating base and said common terminal comprise fourth snap-in means mounting said common terminal on said insulating base before said base is mounted on said housing.

6. The miniature pushbutton switch defined in claim 5, wherein:

said fourth snap-in means comprises lugs on adjacent angular surfaces of said base and a ring on said common terminal adapted to be hooked behind one of said lugs on one surface of said base and a hole on an angular portion of said common terminal adapted to be locked on a second lug on a corresponding angular surface of said base.

7. The miniature pushbutton switch defined in claim 1, wherein said pushbutton comprises:

a tactile finger for engaging said housing when said pushbutton is depressed enabling the user to sense the moment of contact operation.

8. The miniature pushbutton switch defined in claim 7, wherein said tactile finger comprises:

a cam surface having a relatively short radius of curvature continuing into a gradual slope whereby said short radius curvature engages said housing to afford an abrupt hesitation feel upon depression of said pushbutton whereas said gradual slope reduces drag to enable said return spring to restore said pushbutton with minimum force.

9. The miniature pushbutton switch claimed in claim 1, wherein:

said resilient means comprises a spring extending from said common terminal around said stationary contact means to said movable contact;

and said movable contact is elongated so as to engage opposite sides of one end of said spring while the other end of said spring contacts said common terminal.

10. The miniature pushbutton switch claimed in claim 9, wherein:

said common terminal surrounds said stationary contacts and is engaged by the other end of said spring whereby said spring serves both as a pushbutton return spring and as an electrical connector between said movable contact and said common terminal.

11. A miniature pushbutton switch comprising:

a cylindrical insulating housing having a larger diameter portion providing a switch compartment therewithin and a smaller diameter portion providing a bushing for mounting the switch in a hole in a mounting panel;

an opening at the bottom of said switch compartment for receiving a base;

an opening through said bushing;

an enlarged-head pushbutton having a shank extending through said opening in said bushing into said switch compartment;

an elongated movable contact;

snap-in means on the end of said pushbutton shank within said switch compartment retaining said movable contact so as to be movable with said pushbutton;

an insulating base;

snap-in means mounting said base in said opening at the bottom of said switch compartment;

stationary contacts carried by said base so as to extend into said switch compartment for engagement by said movable contact and having external terminals;

a common terminal carried by said base within said switch compartment and having an external terminal;

and an helical spring having a diameter large enough to hug the inside walls of said larger diameter portion of said housing and to freely surround said stationary contacts with sufficient clearance therebetween and being in compression between said common terminal and the opposite end portions of said elongated movable contact serving both as an electrical connector and as a pushbutton return spring.

12. A miniature pushbutton switch comprising:

a cylindrical insulating housing having a larger diameter portion providing a switch compartment therewithin and a smaller diameter portion providing a bushing for mounting the switch in a hole in a mounting panel;

an opening at the bottom of said switch compartment for receiving a base;

an opening through said bushing;

an enlarged-head pushbutton having a shank extending through said opening in said bushing into said switch compartment;

a movable contact;

snap-in means on the end of said pushbutton shank within said switch compartment retaining said movable contact so as to be movable with said pushbutton;

an insulating base;

snap-in means mounting said base in said opening at the bottom of said switch compartment;

stationary contacts carried by said base so as to extend into said switch compartment for engagement by said movable contact and having external terminals;

a common terminal carried by said base within said switch compartment and having an external terminal;

and an helical spring in compression between said common terminal and said movable contact serving both as an electrical connector and as a pushbutton return spring;

said movable contact comprising a cylindrical metal bar having its ends biased by the opposite sides of said helical spring;

and said stationary contacts comprising a resilient normally-closed contact long enough to engage said movable contact bar when said pushbutton is undepressed, and a resilient normally-open contact that is shorter so as to be engaged by said movable contact bar when said pushbutton is fully depressed, and said normally-closed and normally-open contacts extending freely through said helical spring which is large enough in diameter to hug the walls of said switch compartment.

13. The miniature pushbutton switch defined in claim 12 wherein:

said stationary contacts are bifurcated so that each provides two independently resilient contacting elements to assure a good electrical connection to said movable contact.

14. A miniature pushbutton switch comprising:

a cylindrical insulating housing having a larger diameter portion providing a switch compartment therewithin and a smaller diameter portion providing a bushing for mounting the switch in a hole in a mounting panel;

an opening at the bottom of said switch compartment for receiving a base;

an opening through said bushing;

an enlarged-head pushbutton having a shank extending through said opening in said bushing into said switch compartment;

a movable contact;

snap-in means on the end of said pushbutton shank within said switch compartment retaining said movable contact so as to be movable with said pushbutton;

an insulating base;

snap-in means mounting said base in said opening at the bottom of said switch compartment;

stationary contacts carried by said base so as to extend into said switch compartment for engagement by said movable contact and having external terminals;

a common terminal carried by said base within said switch compartment and having an external terminal;

and an helical spring in compression between said common terminal and said movable contact serving both as an electrical connector and as a pushbutton return spring;

said snap-in means that retains said movable contact on said pushbutton also incorporating second snap-in means for retaining said pushbutton in the opening in said bushing.

15. The miniature pushbutton switch defined in claim 14 wherein:

said snap-in means that retains said pushbutton in said opening in said bushing incorporates a flat surface cooperating with a complementary flat surface of said bushing to retain said pushbutton non-rotatably in said opening in said bushing while allowing reciprocal longitudinal movement thereof.

* * * * *